US009963207B2

(12) United States Patent
Nikolaisen

(10) Patent No.: US 9,963,207 B2
(45) Date of Patent: May 8, 2018

(54) INSULATION APPARATUS AND METHOD

(71) Applicant: MGI THERMO PTE LTD, Singapore (SG)

(72) Inventor: Per Ivar Nikolaisen, Drammen (NO)

(73) Assignee: LNT MARINE PTE. LTD., Singapore (SG)

( * ) Notice: Subject to any disclaimer, the term of this patent is extended or adjusted under 35 U.S.C. 154(b) by 0 days. days.

(21) Appl. No.: 15/121,738

(22) PCT Filed: Feb. 27, 2015

(86) PCT No.: PCT/IB2015/051472

§ 371 (c)(1),
(2) Date: Aug. 25, 2016

(87) PCT Pub. No.: WO2015/128848

PCT Pub. Date: Sep. 3, 2015

(65) Prior Publication Data

US 2017/0101163 A1 Apr. 13, 2017

(30) Foreign Application Priority Data

Feb. 28, 2014 (GB) ..... 1403543.0

(51) Int. Cl.
*B63B 25/16* (2006.01)
*F17C 3/02* (2006.01)
*F17C 3/04* (2006.01)

(52) U.S. Cl.
CPC ..... *B63B 25/16* (2013.01); *F17C 3/025* (2013.01); *F17C 3/04* (2013.01); *B63B 2231/10* (2013.01);
(Continued)

(58) Field of Classification Search
CPC ..... B63B 25/00; B63B 25/08; B63B 25/14; B63B 25/16; F17C 1/00; F17C 3/00; F17C 3/025; F17C 3/04; F17C 3/02; F17C 13/00
(Continued)

(56) References Cited

U.S. PATENT DOCUMENTS 3,341,049 A * 9/1967 Forman ..... F17C 3/025 114/74 A
3,341,050 A * 9/1967 Forman ..... F17C 3/025 220/560.12
(Continued)

FOREIGN PATENT DOCUMENTS

CN 101688640 A 3/2010
EP 0628763 B1 3/1996
(Continued)

OTHER PUBLICATIONS

International search report dated Oct. 13, 2015 for PCT Application No. PCT/IB2015/051472.

*Primary Examiner* — Lars A Olson
(74) *Attorney, Agent, or Firm* — Wilson Sonsini Goodrich & Rosati

(57) ABSTRACT

The invention relates to a marine vessel cryogenic barrier which is formed of a plurality of individual panels, each panel being arranged to align with an adjacent panel on an inner surface of a hold space of a marine vessel and comprising a single coupling means at the centre of the panel and an impervious layer on a surface of the barrier facing the hold space.

23 Claims, 14 Drawing Sheets

(52) U.S. Cl.
CPC ... *B63B 2231/40* (2013.01); *F17C 2203/0333* (2013.01); *F17C 2203/0358* (2013.01); *F17C 2203/0624* (2013.01); *F17C 2203/0639* (2013.01); *F17C 2203/0646* (2013.01); *F17C 2221/033* (2013.01); *F17C 2221/035* (2013.01); *F17C 2260/033* (2013.01); *F17C 2270/0107* (2013.01)

(58) Field of Classification Search
USPC ..... 114/74 A, 74 R; 220/560.07, 560.11, 220/560.12
See application file for complete search history.

(56) References Cited

U.S. PATENT DOCUMENTS 3,931,424 A * 1/1976 Helf ..... F17C 3/04 114/74 A
4,106,424 A * 8/1978 Schuler ..... B63B 25/16 114/74 A
4,116,150 A * 9/1978 McCown ..... B63B 25/16 114/74 A
4,170,952 A * 10/1979 McCown ..... B63B 25/16 114/74 A
5,464,116 A 11/1995 Aoki et al.
2007/0028823 A1 2/2007 Yang et al.

FOREIGN PATENT DOCUMENTS

KR 20100127626 A 12/2010
KR 20110046627 A 5/2011
KR 20120136330 A 12/2012
KR 20130045701 A 5/2013
KR 20130083631 A 7/2013
WO WO-2008147003 A1 12/2008
WO WO-2015128848 A2 9/2015
WO WO-2015128848 A3 1/2016

* cited by examiner

INSULATION APPARATUS AND METHOD

BACKGROUND

The present invention relates to an insulation system and method for insulating marine vessels. In particular, but not exclusively, the invention relates to vessels that are adapted to transport cryogenic liquids. Examples of such liquids include liquefied natural gas (LNG), liquefied propane gas (LPG) or liquefied ethylene gas (LEG).

The invention can also be applied to other applications where insulation is required.

International agreements determine the type and construction of marine vessels/ships which may be used to transport cryogenic liquids. Specifically, the regulations define how the cryogenic liquid is safely contained on the ship and importantly how the liquid can be contained should a hold fail.

Cryogenic transport ships are designed according to regulations that require the containment holds to have very high integrity. The International Maritime Organisation (IMO) sets these regulations. Holds must be constructed such that the holds do not fail and allow liquid to be released. These designs require high integrity welding and thick hold walls, such as IMO type C and B holds. They are extremely safe but inherently expensive to manufacture and maintain.

As the use of cryogenic liquids increases there is a growing need for transport systems that allow these liquids to be safely transported in varying quantities and at competitive prices. The cost of constructing and operating conventional cryogenic transport ships is a barrier preventing the fuels being more widely distributed and utilised.

The inventor of the present technology has devised a system which allows cryogenic transport ships to be constructed at vastly reduced costs whilst maintaining very high safety standards. Furthermore, the technology can be applied to existing ship designs and easily and efficiently incorporated in a ship's structure. The technology may even be retro-fitted to existing ships.

SUMMARY OF THE INVENTION

According to a first aspect of an invention described herein there is provided a marine vessel cryogenic barrier, comprising a plurality of multi-layered insulation panels, each panel arranged to align with an adjacent panel on an inner surface of a hold space of a marine vessel, each panel comprising a single coupling means located at the centre of the panel and arranged to couple the respective panel to the inner surface of the hold space of the marine vessel, wherein the barrier is provided with an impervious layer on a surface of the barrier facing the hold space.

Thus, according to a first aspect of an invention described herein there is provided a barrier system that functions as a combined secondary barrier and also an insulation system. Liquid can thereby both be contained and also shielded from the ship's structure, primarily the hull. The insulation is located on the vessel's hull structure inside the void space where the hold is located.

The term 'single coupling' is intended to refer to the primary coupling connecting the panel to the vessel. The term impervious refers to a layer that does not allow cryogenic liquid to pass there through within the context and as defined by IMO regulations.

The temperature needed to transport LNG (as one example) is −163 degrees C. and it is essential that the hull of the ship is never exposed to such low temperatures.

According to the present invention the insulation panels can be connected to the hull structure of the ship within the hold space. This advantageously allows the hold itself to be inspected and maintained without being concealed by an insulating layer. This maximises the operational life of the primary hold and the useful life of the vessel. Safety is also inherently improved. Also, the insulation with a secondary barrier according to the invention is always accessible and can be inspected and repaired when required.

The arrangement also allows the insulation to be fitted to the vessel with relative ease owing, in part, to the single coupling arrangements for each panel. This minimises expensive manufacturing work in readying the vessel for LNG transport.

Still further the impervious layer provided by the barrier provides a secondary containment barrier should the primary barrier (the LNG hold) suffer a leak or catastrophic failure.

Thus, according to an invention described herein there is provided a combined and integrated cryogenic insulation and secondary barrier system. The secondary barrier allows for an IMO type A vessel to be used to transport LNG which substantially reduces manufacturing time and cost. The barrier according to the invention allows the safely standards required to convey LNG to be maintained.

Each panel forming the barrier may itself be formed of multiple insulating layers.

For example, the barrier may comprise a main and secondary insulation layer separated by an optional intermediate layer, wherein the main and secondary insulation layers are not bonded to each other or to the intermediate layer. Allowing two insulating layers within the panel to be separated in this way advantageously gives the panel improved thermal expansion and mechanical movement performance. Large marine vessels flex in different directions as well as changing shape with thermal conditions. Allowing each of a plurality of panels to accommodate a small amount of movement in this way prevent stress and fractures occurring to the insulation or the impervious layer.

The insulation material itself will be defined for the particular application and intended cargo. One suitable material is a polyurethane layer having suitable thermal properties. The material type and the thickness of each panel will be selected according to the given application.

The impervious layer will similarly be selected according to the application and intended liquid. However, one of a number of suitable materials the inventor has identified is an alufoil material. This material is a glass fibre woven cloth which is impregnated and coated with a cargo aluminium layer. Such a material is impervious to liquid natural gas and can withstand the extremely low temperatures for extended period of time.

It is worth noting that IMO requirements stipulate that a secondary barrier system must be capable of containing the LNG cargo for 15 days after a partial or complete failure of the primary containment hold.

Each panel may be any suitable shape. However, the shape must be selected so that the panels can all tessellate along the inner surface of the hold space. The entire surface of the hold space must be covered to ensure that any failure of the primary containment hold does not bring LNG into contact with the hull.

Advantageously the panels may be 1 metre square panels with a centrally located fixing hole. This allows the panels to be easily handled by an installation team and tessellated along the hold space wall. Other shapes may also be used depending on the profile and shape of the vessel hold space.

For example curved sections may be employed at the corners of the hull but all with the common single coupling feature.

Thermal expansion and contraction of the marine vessel as well as flexing of the vessel during movement mean that the barrier system may advantageously accommodate these thermally induced dimensional changes as well as the mechanically induces movements of the vessel.

Thus, the panels are advantageously positioned so that they do not abut adjacent panels but instead provide clearance or a space between each and every adjacent panel. This is counter-intuitive in that a space is deliberately provided between adjacent panels along the surface of the hold space.

However, once each panel is in-situ each of the spaces between adjacent panels is arranged to be filled with an expanding foam or similar insulating material. Each panel is produced with a flexible layer of mineral wool on all sides against adjacent panels. The expanding foam (such as polyurethane) fills the entire space between the adjacent panels. Additionally the expansion of the foam applies a small compressive force on each panel that compress the mineral wool and providing a seal and also solidly engaging the foam within the space between the panels. This provides a strong and resilient connection between the foam layer and each panel and prevents heat passing though the space towards the hull. The compressed mineral wool, bonded to the polyurethane panel and the expanded in-situ foam between the panels, will allow for movements in all direction.

The space between each adjacent panel must also be provided with an impervious layer or cap to provide the uniform impervious layer between panels and across the entire surface of the barrier.

This may be provided with a reinforced flexible aluminium or a cryogenic coating layer extending from the inner facing surface of one panel, across the space or joint, and to the inner surface of an adjacent panel. This caps the space into which the foam has been introduced and prevents in the ingress of LNG.

The layer may be bonded in any suitable way but is advantageously bonded with a cryogenic glue to securely connect or bond the layer to both adjacent panels.

Although the flexible material is able to accommodate lateral movement between panels (owing to its flexibility and shape) the inventor has established that advantageously the layer should be arranged such that an excess of material is used to cover each respecting joint between adjacent panels. In effect a concave or convex portion is provided or 'dip', crest or protrusion by providing excess material i.e. a greater length of material than is require to precisely reach over the joint.

Advantageously the resulting concave/convex portion forming the joint additionally accommodates lateral movement of adjacent panels. The panel is thus able to accommodate movements of +−3.5 mm in each direction on each side of each panel.

Each panel is secured to the hold space using a single coupling. The coupling is located in the centre of the panel thereby maximising the lateral expansion and flexing of the vessel the barrier system can accommodate.

The coupling may be any suitable arrangement. However, a single threaded stud connected to the hull and extending generally perpendicularly to the vessel wall conveniently allows each panel to be put in place. The stud may be accurately positioned using a laser to ensure that the separation of the resulting panels (relative to each adjacent panel) is accurate. The tolerance for the stud may for example be 3 mm.

The panels may advantageously be connected to each threaded rod using a locking nut thus preventing the panel from loosening once in position. Thus, the stud is connected to the hull, the panel locked on the stud, the stud passing through a hole in the panel and the locking nut secured on the thread.

In order to spread the force created by the locking nut and to bring the panel into contact with the inner surface of the hull, the hole through which the threaded rod passes may be larger in diameter on the hold facing side of the panel. This advantageously allows the locking nut to be fastened on the thread by the installation team but also allows an anchoring plate to be placed over the threaded rod before the locking nut is fastened. The anchor may be in the form of a disc or square plate and arranged to pass over the threaded rod and engage with the bottom of the enlarged diameter hole. The anchor may also be made like a cup with collar plates out on the plywood surface to secure mechanical fixation form hull structure too panel plywood surface.

In order to maintain the thermal performance of the panel the locking nut and anchor plate may be arranged to terminate part way through the panel. This advantageously allows the space above the nut and anchor plate to be filled with insulation material to restore the thermal properties of the panel. Thus, the connection joining the panel to the vessel wall is located within the panel and not near to the surface. This will reduce the heat ingress through the stud bolt The surface of the panel above the nut and anchor plate may similarly be sealed with an impervious layer of aluminium foil and securely with a cryogenic glue or with a layer of cryogenic coating to retain the impervious integrity of the surface of the panel.

Thus, once in-situ the joints between adjacent panels and the space above the locking nut and anchor plate for each panel are both insulated and impervious giving a uniformity to the barrier across each and every panel.

An intermediate layer within each panel may itself be a multi-layered arrangement. For example the intermediate layer may be formed of a plywood substrate to provide strength with an aluminium layer bonded thereto to provide the secondary barrier.

The secondary layer may also be provided with a locking nut arranged to secure the secondary layer to a threaded rod passing through the panel. Thus a pair of secure connection to the hull may be provided.

As described above the lateral movement of adjacent panels is accommodated at the junction of adjacent panels using a flexible joint arrangement. However, at corner points where four panels meets the movements of four panels in a plurality of directions requires an innovative alternative joint to accommodate the thermal and mechanical movements of each of the four panels simultaneously.

Thus, each panel may advantageously be truncated such that, in use, aligning adjacent panels defines an open space at the point at which four adjacent panels meet. The open space defines a corner joint space which may be filled with an insulating material (such as mineral wool) in the same way the other joints are insulated. Again the foam extends between the edges of adjacent panels and entirely fills the corner space between adjacent panels creating a strong insulating bond.

The impervious properties of the corner joint may be provided by sealing across the joint between 4 adjacent panels using an impervious reinforced flexible aluminium layer or a layer of cryogenic coating. Advantageously the layer overlaps a portion of the adjacent panels on a tank space facing surface.

As with the side joints described above the flexible reinforced aluminium layer or the layer of cryogenic coating is bonded to adjacent panels such that an excess of material is provided across the corner joint and the material may be arranged so as to provide a concave or convex dome joint profile between adjacent corner panels. The concave or convex dome allows for the relative movements of the four adjacent panels whilst maintaining the impervious properties of the layer at the joint.

Any suitable geometric shape may be used instead of the convex or concave dome provided that the excess material across each corner joint is sufficient to accommodate the combined relative movements of the four adjacent panels.

Viewed from another aspect there is provided a multi-layer cryogenic barrier panel for aligning with an adjacent panel on an inner surface of a hold space of a marine vessel, said panel comprising a single through-hole at the centre of the panel arranged to receive a coupling means, wherein the panel comprises a main impervious layer on an outer surface of said panel and a second impervious layer within the multi-layer panel.

Thus, according to another aspect there is provided a panel for use in a cryogenic application which acts as a secondary containment barrier thereby permitting alternative class types of marine vessel to be used as cryogenic transporters.

Viewed from yet another aspect there is provided a method of insulating a marine cryogenic liquid transporter, said method comprising the steps of (A) fitting a plurality of securing studs to an inner surface of a hold space of a transporter, (B) securing a plurality of panels as described herein to each of said securing studs, (C) sealing the spaces between adjacent panels with an expanding foam and (D) covering the spaces between adjacent panels on a hold space facing side of each panel with a impervious material to create an uninterrupted impervious barrier within the hold space.

Viewed from a still further aspect there is provided a marine vessel cryogenic barrier, comprising a plurality of multi-layered insulation panels, each panel arranged to align with an adjacent panel on an inner surface of a hold space of a marine vessel, each panel comprising a single coupling means located at the centre of the panel, said barrier comprising a first impervious layer on a surface of the barrier facing the hold space and a second impervious layer arranged within the panel and further comprising a peripherally arranged impervious joint arranged in use to connect adjacent panels to each other.

Viewed from another aspect there is provided an LNG fuel containment apparatus comprising a primary LNG fuel hold and a secondary containment barrier arranged around said primary LNG fuel hold, said secondary containment barrier comprising a plurality of multi-layered insulation panels, each panel arranged to align with an adjacent panel, said barrier comprising a first impervious layer on a surface of the barrier and a second impervious layer arranged within the panel and further comprising a peripherally arranged impervious joint arranged in use to connect adjacent panels to each other.

In each of the embodiments described herein the single coupling could be replaced with a plurality of coupling, for example one generally at each corner of a panel. Such an arrangement would not benefit from the single couplings ability to accommodate thermal expansion of the panels but may be employed where the thermal expansion advantages are not required. It will be recognised that such a coupling configuration can be used in combination with each and every feature associated with the single coupling embodiment.

BRIEF DESCRIPTION OF THE FIGURES

Aspects of the invention will now be described, by way of example only, with reference to the accompanying figures in which:

FIGS. 12 to 16 show a barrier arrangement according to a best mode;

FIG. 12 shows two adjacent panels according to a best mode;

FIG. 13 shows the panel of FIG. 12 in cross-section;

FIG. 14 shows the joint between adjacent panels of FIG. 12 in cross-section;

FIG. 16 shows a joint cap seal in cross-section.

Figure 1:
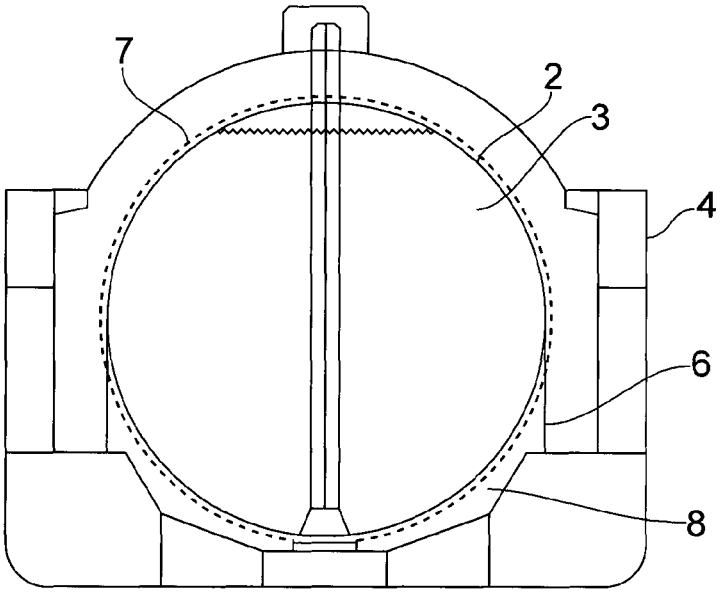
FIG. 1 shows a conventional LNG cryogenic transport vessel using a spherical hold.

While the invention is susceptible to various modifications and alternative forms, specific embodiments are shown by way of example in the drawings and are herein described in detail. It should be understood however that the drawings and detailed description attached hereto are not intended to limit the invention to the particular form disclosed but rather the invention is to cover all modifications, equivalents and alternatives falling within the spirit and scope of the claimed invention.

In addition it will be recognised that the various features of each embodiment may be used in combination with each other and features of each embodiment, as well as features between embodiments and the best mode, are not limited or restricted to use with a given embodiment.

DETAILED DESCRIPTION

FIG. 1 shows a cross-section of an LNG cryogenic transport vessel comprising a spherical containment hold.

Such a vessel is commonly used to transport large quantities of LNG and other cryogenic liquids.

The conventional marine vessel (ship) 1, commonly known as a "Moss design", IMO type B comprises a spherical primary containment hold 2 which is arranged to contain the LNG cargo 3. The upper limit of the LNG within the hold 2 is shown. Commonly an LNG holder will contain multiple holds 2 mounted along the length of the holder. Only one is shown for illustration.

The hold 2 is mounted within the hull of the ship 1 and is supported about its waist 5 by a skirt 6. Thus, the hold 2 is spaced from the hull 4 by the voids 8.

The hold contains a centrally located pipe tower and a drip tray beneath the hold within the void 8. The hold 2, forming the primary barrier, is surrounded by an insulation layer 7.

The hold 2 is itself insulated and the insulation in combination with the voids 8 prevents the cold hold contacting or cooling the hull. Should the low temperature LNG contact the steel this would undesirably reduce the steel temperature and make the steel brittle.

The hold 2 is designed to extremely high specifications such that it will not fail. The cost of manufacturing LNG vessels in this way is extremely expensive and the cost does not make it feasible to build large numbers of vessels or indeed smaller vessels for containing and transporting smaller quantities of LNG over increased delivery routes.

Figure 2A:
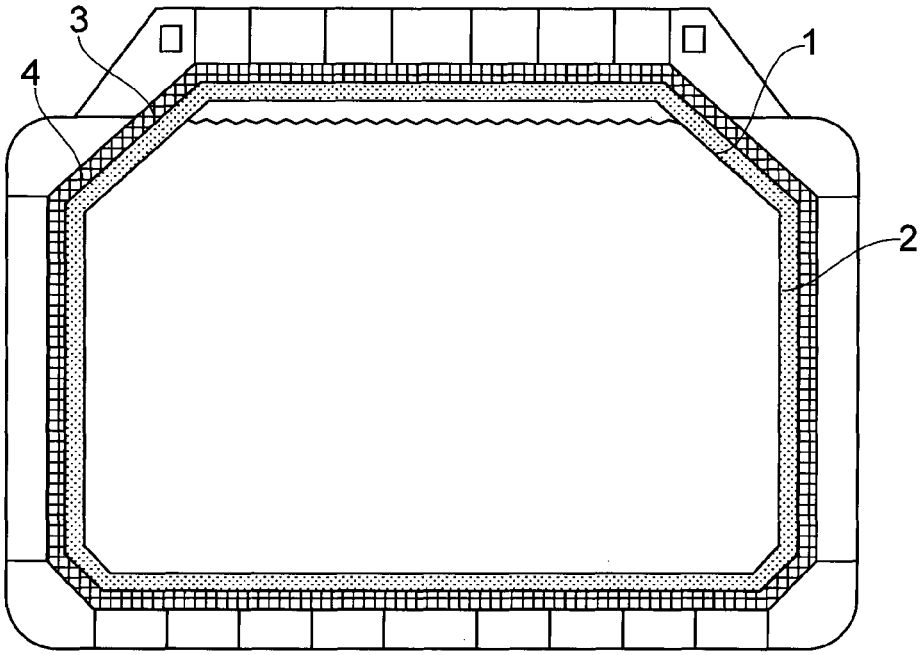
FIG. 2A shows a cross-section through a conventional non-spherical vessel.

FIG. 2A shows a cross-section through a containment system for a non-spherical hold and is known as an integral membrane vessel. The system comprises a primary barrier membrane 1, a primary insulation 2, a secondary barrier 3 and a secondary insulation 4 as shown in FIG. 2A.

Figure 2B:
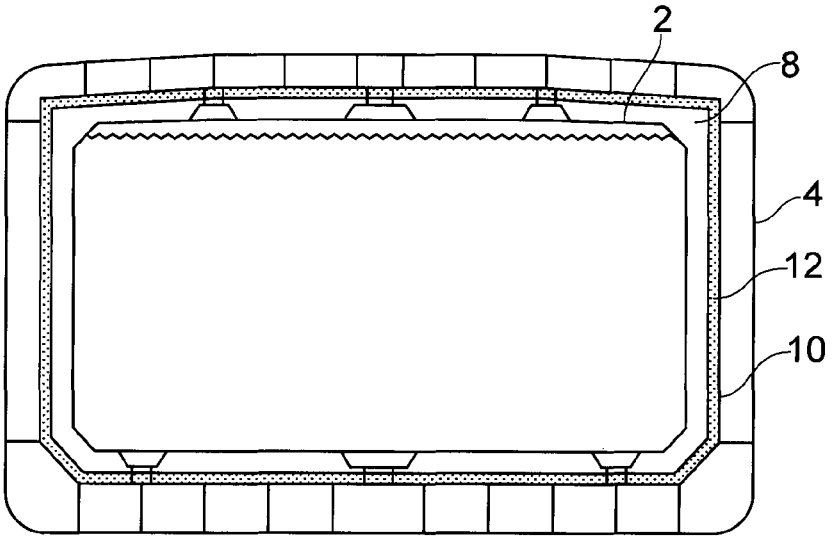
FIG. 2B shows a cross-section through an IMO type A vessel having a prismatic hold incorporating the insulation system according to an invention described herein.

FIG. 2B shows a preferred embodiment of the invention in which a central hold 2 is surrounded by a void 8. The hull 4 is lined with the cryogenic barrier 12 described herein to create a marine vessel suitable for transporting cryogenic liquids. This is known in the art as an IMO-A type vessel.

According to the present invention instead of insulating the hold, the hull is insulated by a cryogenic barrier 12. The barrier 12 is arranged to line the entire hold space of the vessel.

Although a space or void 8 is shown in FIG. 2B in the cross-section the barrier may be arranged to be close to the hold surface with a small inspection/maintenance space between the hold and the hold facing surface of the barrier 12.

IMO type A holds are not considered to be 100% safe and leakage and collapse of the hold can occur. It is a requirement to have a full secondary barrier which protects the hull structure from harmful low temperatures in case of collapse of the main hold.

The vessel design shown in FIG. 2B according to the invention allows for a lower specification of primary LNG. Specifically it allows for the use of an IMO type A hold for the transportation of LNG. This presents significant technical, financial and operational advantages. According the present invention there is provided a hold 2 with a secondary barrier which can contain any leaked LNG for at least 15 days. According to the present invention the barrier 12 not only provides an insulating layer separating the cold hold 2 from the hull 4 but also advantageously incorporates a secondary barrier. In fact a pair of secondary barriers can be integrated into the cryogenic barrier of the invention if desired.

The installation and construction of the cryogenic barrier according to the invention will now be described.

Figure 3:
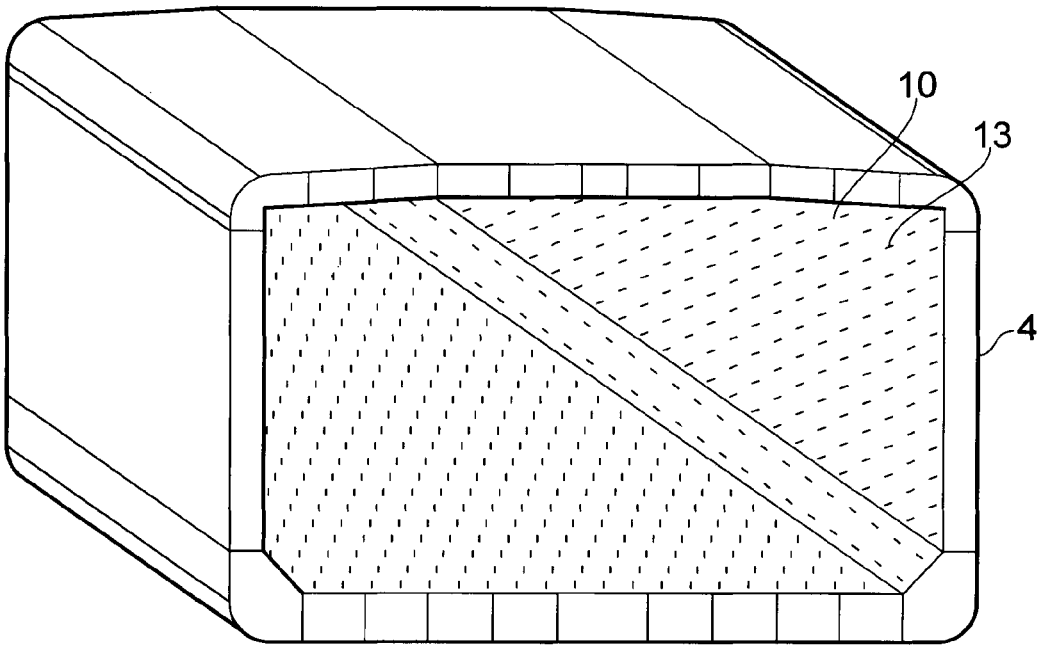
FIG. 3 shows a cross-section of the inner surface of the vessel in FIG. 2B.

FIG. 3 shows a cross-section of the vessel in FIG. 2B without the primary containment hold 2.

As set out above, the present invention provides a marine vessel cryogenic barrier comprising a plurality of multi-layered insulation panels. Each of the panels is arranged to align with an adjacent panel on an inner surface of a hold space 10 of a marine vessel and each panel has a single coupling means located at the centre of the panel. This coupling is arranged to couple the respective panel to the inner surface of the hold space of the marine vessel.

The single coupling for each panel can be illustrated by the coupling locations 13 shown in FIG. 3. The couplings 13 define a matrix for the square panels that are to be installed to line the hold space of the vessel. Each of the coupling locations represents a coupling that is connected to the hull 4 of the vessel either directly or via a frame, discussed further below. As shown the coupling matrix extends along the entire area of the hold space 10.

A first arrangement of a cryogenic barrier system will now be described.

Figure 4:
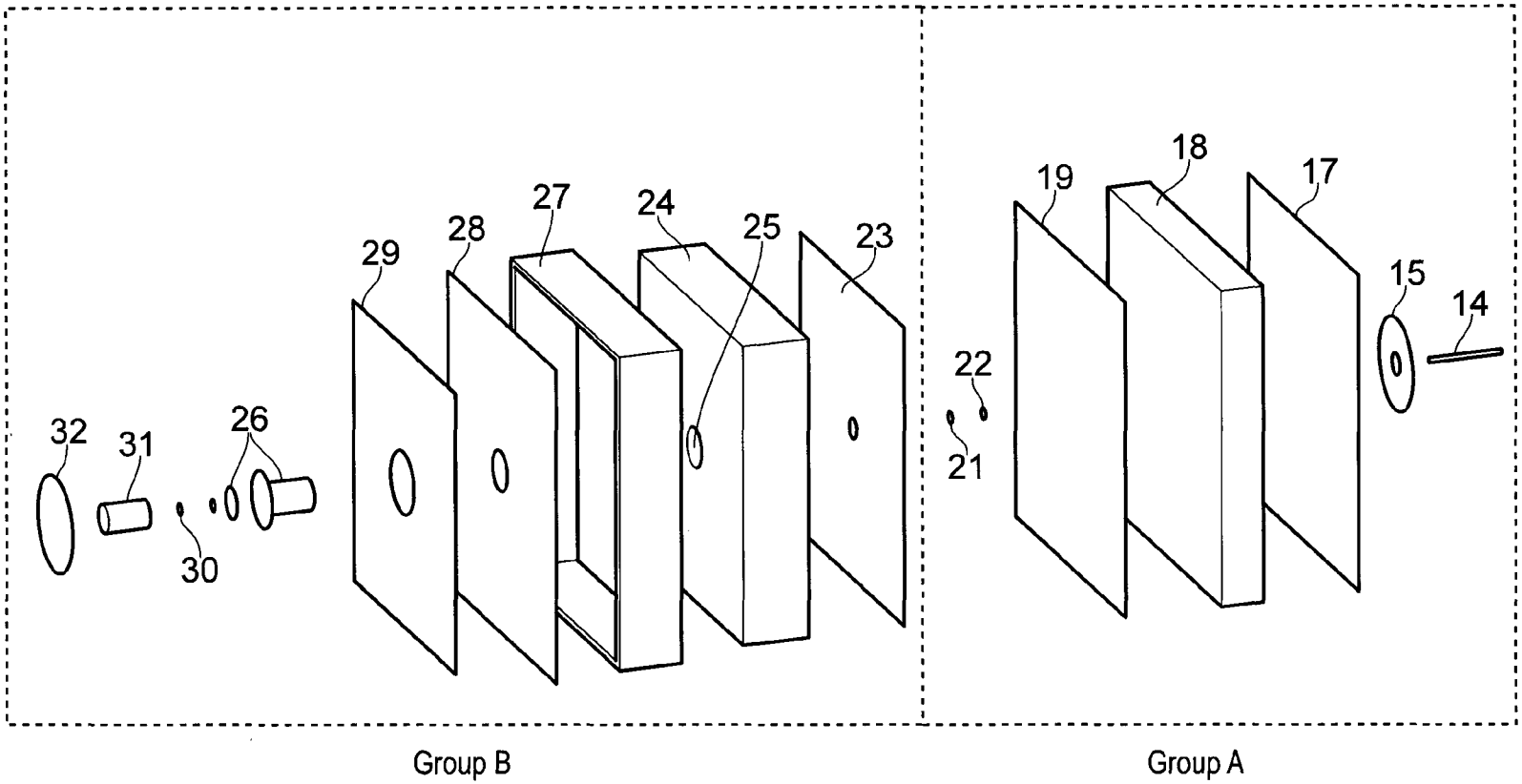
FIG. 4 shows an exploded view of an individual panel according to one embodiment of the invention.

FIG. 4 shows an exploded view of an individual panel according to an embodiment of the invention. The component parts of the panel are assembled at different stages. FIG. 4 illustrated the component parts of the fully assembled panel.

The right hand side of FIG. 4 represents the part of the panel proximate to the vessel's hull 4 and the left hand side to the panel proximate the LNG hold 2. These can be referred to as warm and cold sides respectively.

The panel comprises a threaded coupling rod 14 which is connected to the hull (or a hull connection frame described below). The rod 14 is arranged to pass through the centre of the panel. A single rod is provided per panel. The rod is provided with a support disc 15 to support the panel against the hull or framework The multi-layers panel is formed of the following layers. First, a crack arresting layer 17 is provided to seal the outer surface of the panel and prevent cracking and degradation.

A warm side insulation panel 18 formed of a polyurethane foam is then followed by a ply-wood surface protection and contraction layer 19.

A locking nut 21 secures the warm side assembly together and is sealed with a washer 22. It should be noted that once assembled the locking nut 21 is actually closer to the hull wall than the locking nut 16 as will be described below.

A second crack arrester layer 23 is then provided on the outer surface of the cold side insulation panel 24 which is the substantive insulation layer of the panel.

It should be noted that the first panel sub-group A is not bonded across its surface to the first group B. The two sub-groups are only connected together by means of the centrally located coupling means. Thus, thermal and mechanical movements of the respective pairs to not impart mechanical loads on each other and so stress and resulting damage/fatigue can be mitigated. Such forces are created by movement of the vessel and thermal expansion and contraction.

Figure 6:
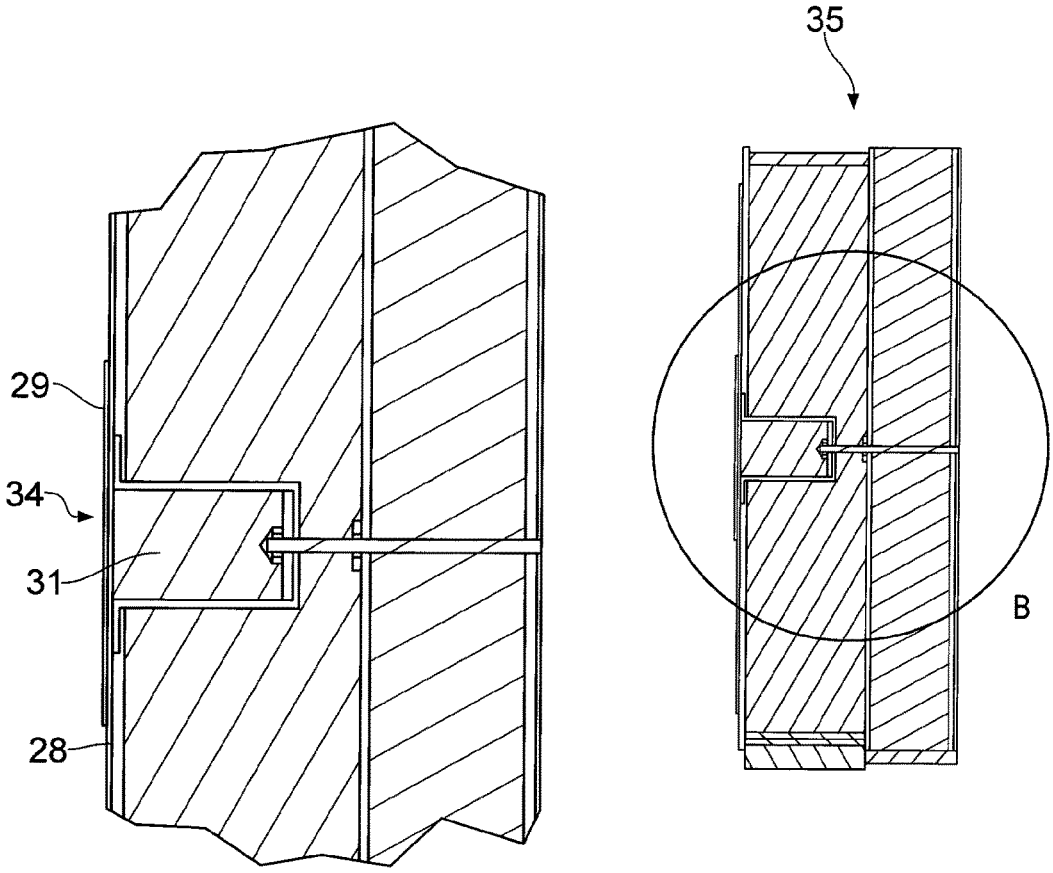
FIG. 6 shows the coupling and panel in cross-section shown in FIG. 4.

The main panel 24 comprises an enlarged central cylindrical chamber 25 into which the distal end of the threaded rod 14 extends when the panel is assembled. The chamber 25 extends part-way through the width of the main panel as shown in FIG. 6 and described below.

The panel is secured to the rod 14 by means of an anchor arrangement 26 which is a disc or washer having a larger surface area that the cross-sectional surface area of the rod 14. A locking nut 30 secures the threaded rod to the panel and on tightening brings the anchor plate into contact with the bottom of the chamber to hold the first and second sub-assemblies A and B to the hull i.e. the anchor plate holds the panel together and secures it to the hull.

A flexible zone 27 surrounds the perimeter of the main panel, the main panel being formed of a polyurethane foam. The flexible zone is caused by the injection of foam into the joints surrounding the panel as described further below. The flexible zone accommodates relative movement of adjacent panels caused by mechanical and/or thermal movement and retains a tight seal and contact between adjacent panels.

As surface protection layer and contraction control layer 28 is arrange immediately on top of the cold surface of the main panel which is itself coated with an impervious layer 29 such as reinforced aluminium foil, a cryogenic coating, or other layer impervious to cryogenic liquid.

The outer layer has a minimum thickness of 0.05 mm.

In order to secure the thermal and mechanical integrity of the assembled panel foam 31 is introduced through the control layer 28 and impervious layer 29 (there being a small hole provided in the centre of the panel. A polyurethane foam is injected into the hole which fills the chamber 25 providing the main panel with uniform insulation properties. The hole in the impervious layer 29 is then sealed with an impervious sealing foil or cryogenic coating 32. The integrity of the impervious layer 29 is therefore restored.

Figure 5:
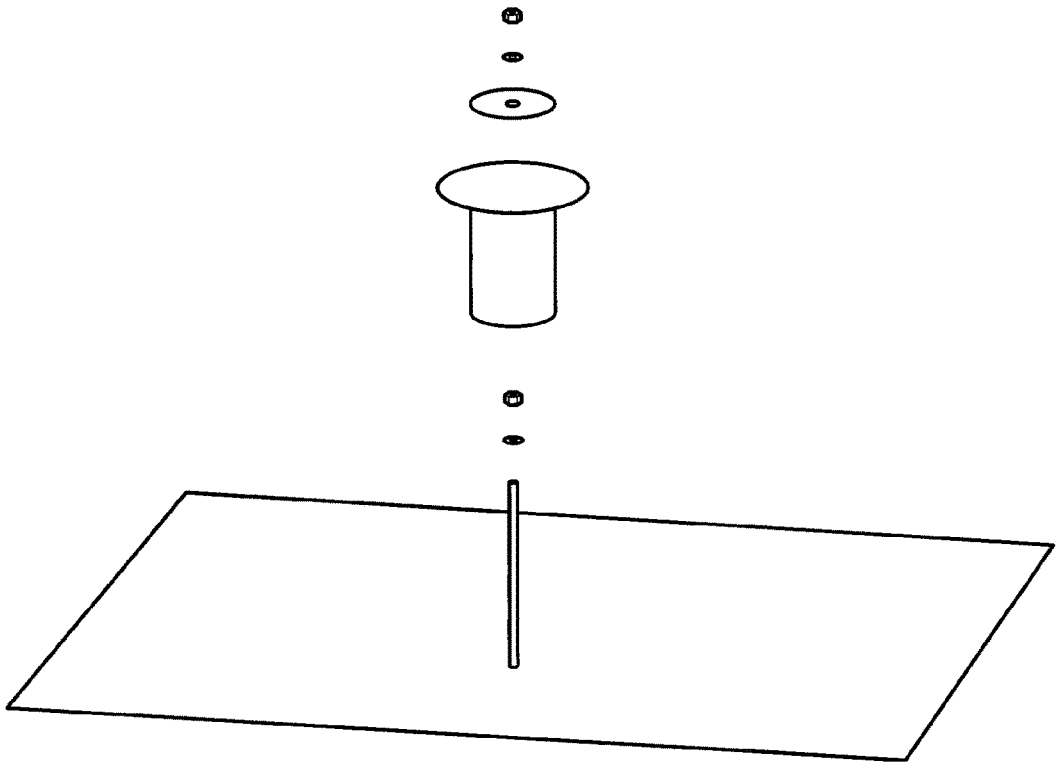
FIG. 5 shows an example coupling arrangement of the embodiment shown in FIG. 4.

FIG. 5 shows a coupling arrangement of this embodiment in more detail with the rod 14, anchor plate and locking nut 30.

FIG. 6 shows the constructed panel and coupling in cross-section. Like reference numerals are used to show the component parts in the assembled panel. FIG. 6 also shows the foam injection hole 34 used to introduce foam into the chamber 31 to seal the chamber and restore uniform thermal insulation properties. The complete assembled panel is show at reference 35.

Figure 7:
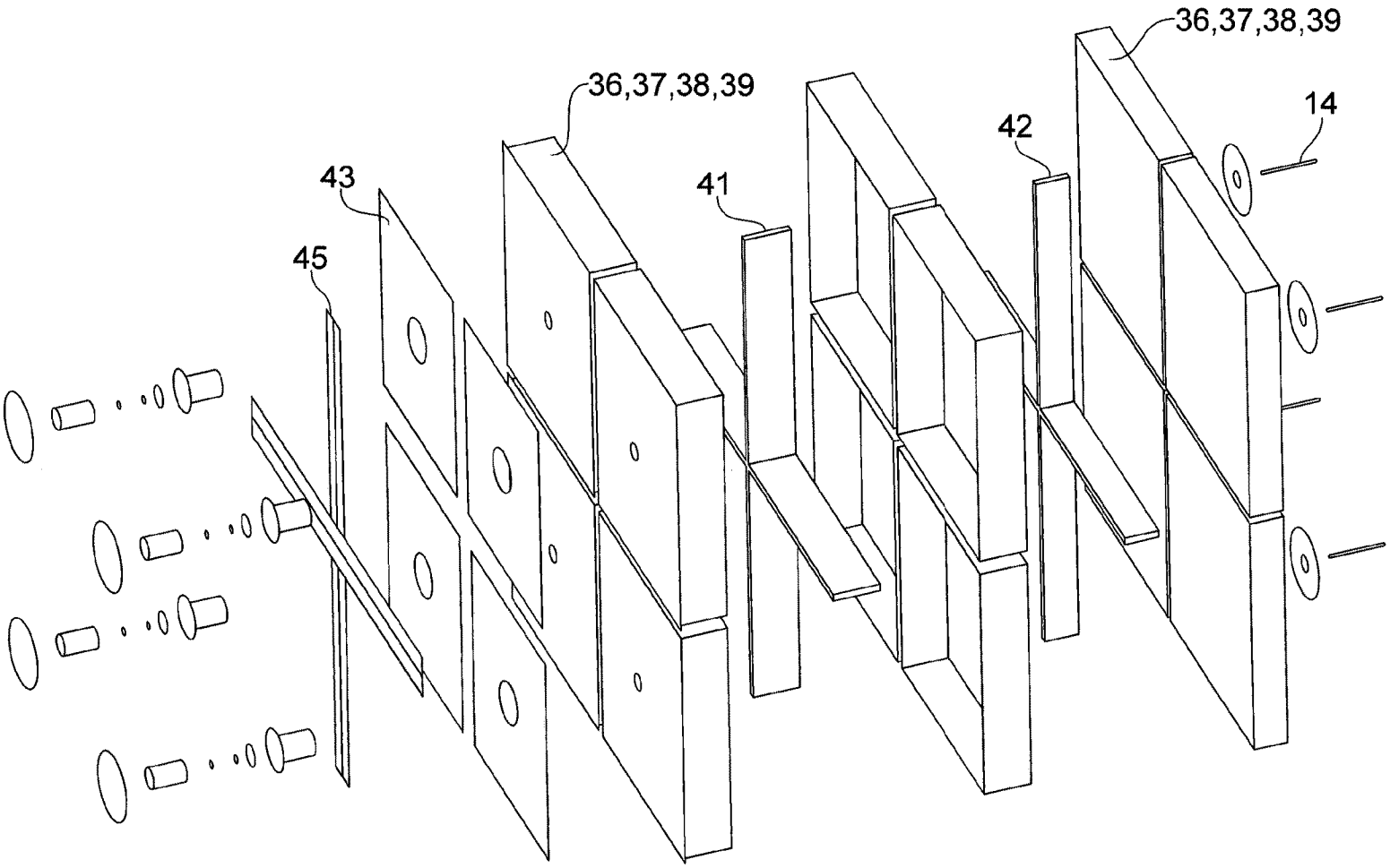
FIG. 7 shows an exploded view of a panel assembly frame shown in FIG. 4 comprising 4 panels and associated seals and components.

FIG. 7 shows an exploded view of a panel assembly frame comprising four panels and associated seals and components between adjacent panels.

The 4 panels 36, 37, 38, 39 are shown.

The panels are separated into the main and secondary sub-assemblies (shown as group A and B). This is because the main and secondary panels are not directly bonded to each other. They are connected together by means of the rods 14 passing through each panel at the centre-point.

The joints between adjacent panels are filled with a polyurethane foam described further below. The flexible zone of FIG. 4 is formed of injected foam defining the perimeter seals 42. An Impervious layer 29 and protection layer 28 are shown as a single layer 43 in FIG. 6.

The joint seal 45 between the layers forming the panels of the warm side insulation panels will be described with reference to FIGS. 9 to 11.

Figure 8:
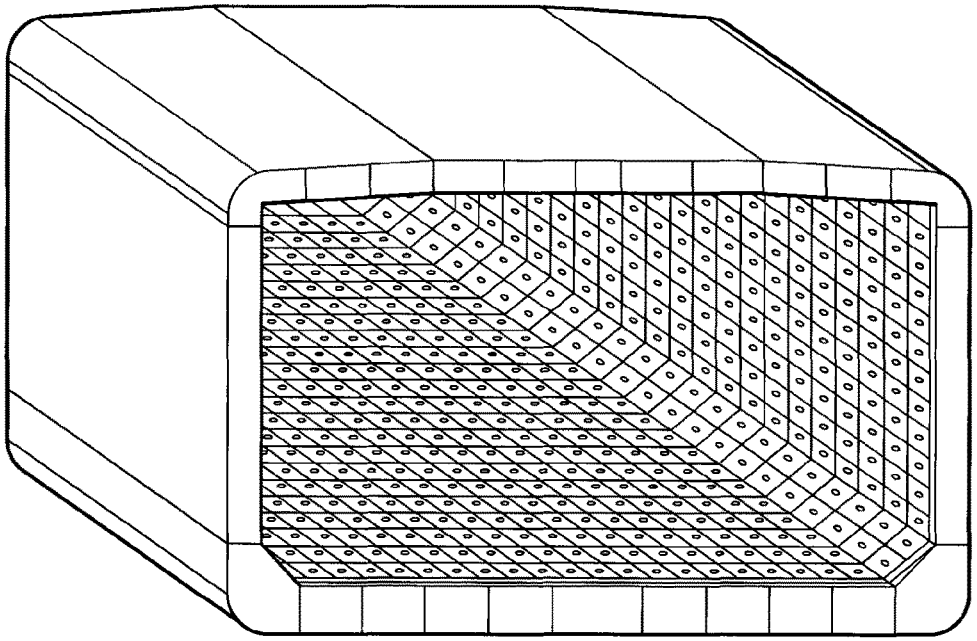
FIG. 8 is a schematic showing the inside of the hold space lined with the panels according to the present invention.

FIG. 8 is a schematic showing the inside of the hold space lined with the tessellated panels.

Figure 9:
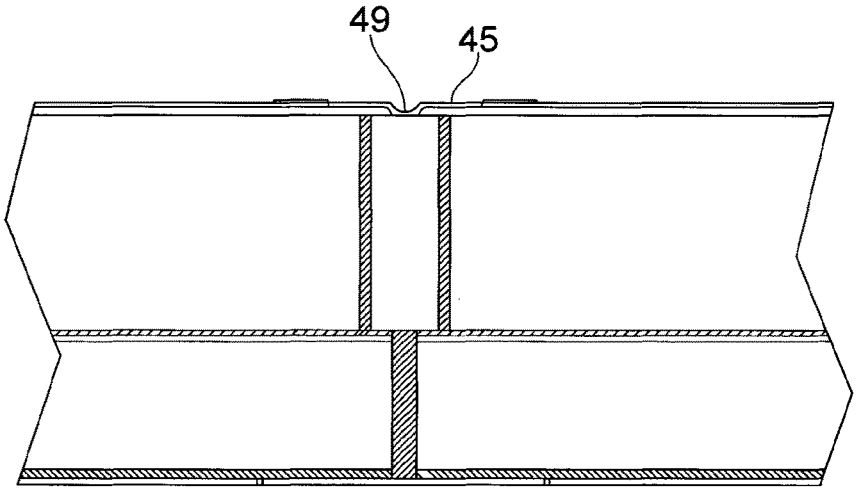
FIG. 9 shows a secondary barrier seal arrangement according to one implementation of an invention.

FIG. 9 shows the secondary barrier seal arrangement 45 according to a first embodiment and the foil arrangement used to seal along the joint between adjacent panels.

FIG. 9 also shows the concave portion 49 of the impervious joint layer extending between adjacent panels. This is formed by bonding the layer to the adjacent panels with a surplus of material. This concave or curve portion allows for movement of adjacent panels at both the main and secondary levels without straining the respective impervious layers.

Figure 10:
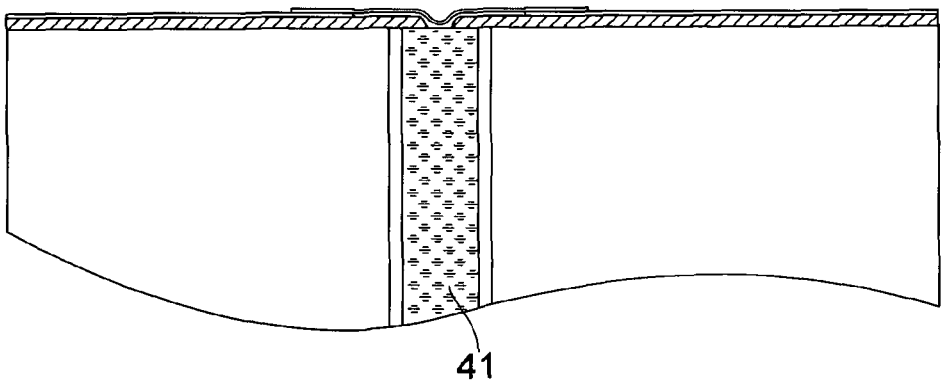
FIG. 10 shows a cross-section of a panel illustrating a cryogenic joint.

FIG. 10 also shows the foam layer 41 (also shown in FIG. 7) which is introduced into the joint between adjacent panels to seal the joint and provide the flex zones.

Figure 11A:
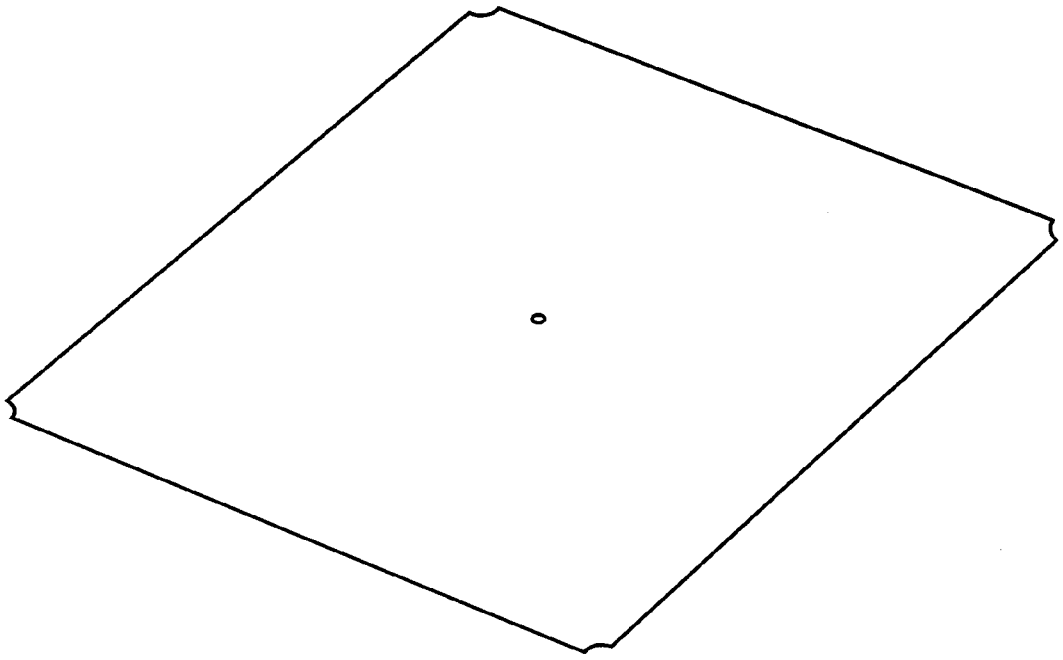
FIGS. 11A, 11B and 11C show a corner joint between 4 adjacent panels.
Figure 11B:
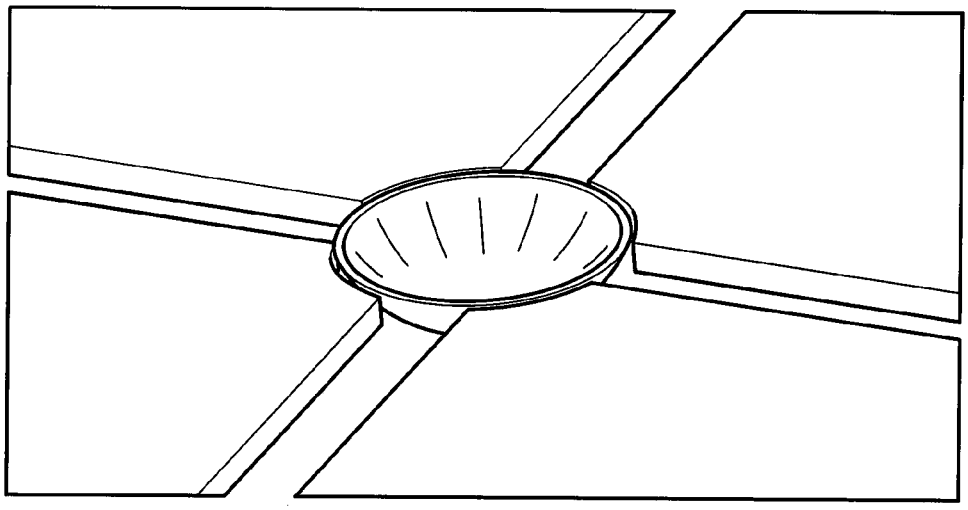
Figure 11C:
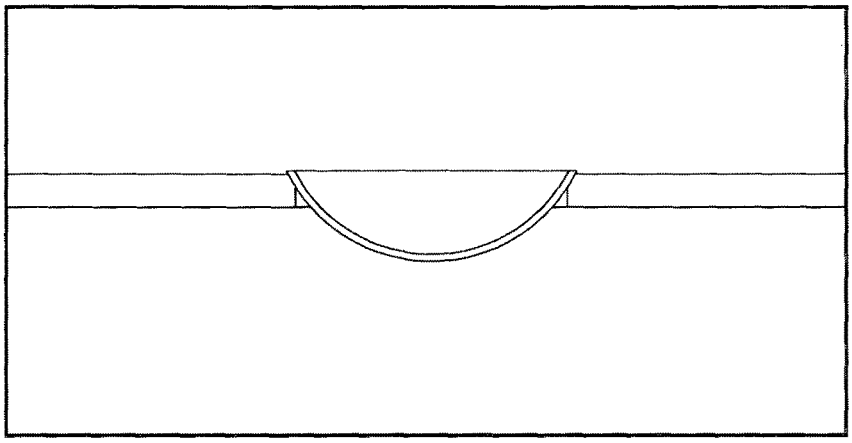

FIGS. 11A, 11B and 11C show different possible corner joint between 4 adjacent panels. FIG. 11A shows a panel with corner portions cut away in a generally semi-circular shape. FIGS. 11B and 11C show one arrangement in which a convex dome portion is defined. The excess material defining the convex portion allows for relative movement of the 4 adjacent panels in each direction. This thereby retains the integrity of the barrier at corned joints.

The cryogenic barrier may be installed as follows:

First, the coupling points are connected to the hold space wall directly onto the hull. Each individual panel is pre-manufactured and delivered to the installation site. The panels are then aligned with the coupling rods, the anchor plates installed and the lock nut tightened and secured. The cover comprising the surface protection layer and impervious layer is put in place and polyurethane foam is injected into the chamber located above the lock nut to seal the chamber.

The hole through which the foam is injected is then sealed with a impervious patch covering the hole and bonded using a cryogenically resistant glue.

Next, the joints between adjacent panels are filled with polyurethane foam.

The preferred embodiment (alternatively termed best mode) will now be described.

The preferred embodiment represents an overall improved implementation over the embodiment described above. However, it will be recognised that aspects and features of each may advantageously be interchanged.

Figure 12:
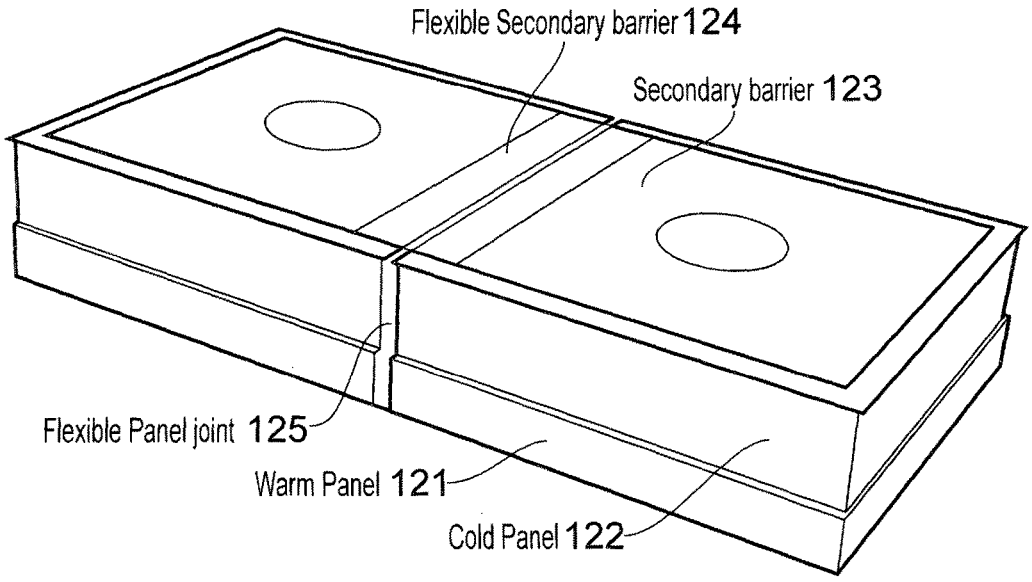

FIG. 12 shows two adjacent panels according to the preferred embodiment of the invention. Each panel comprises a warm panel 121 and a cold panel 122.

The outer face, that is the face of the panel arranged to face the primary hold of the vessel (ship), is covered with a secondary barrier layer 123. The gap between adjacent panels is sealed by means of a flexible secondary barrier strip 124.

The space between adjacent panels is filled with a flexible panel joint 125. These features are described in more detail below.

Figure 13:
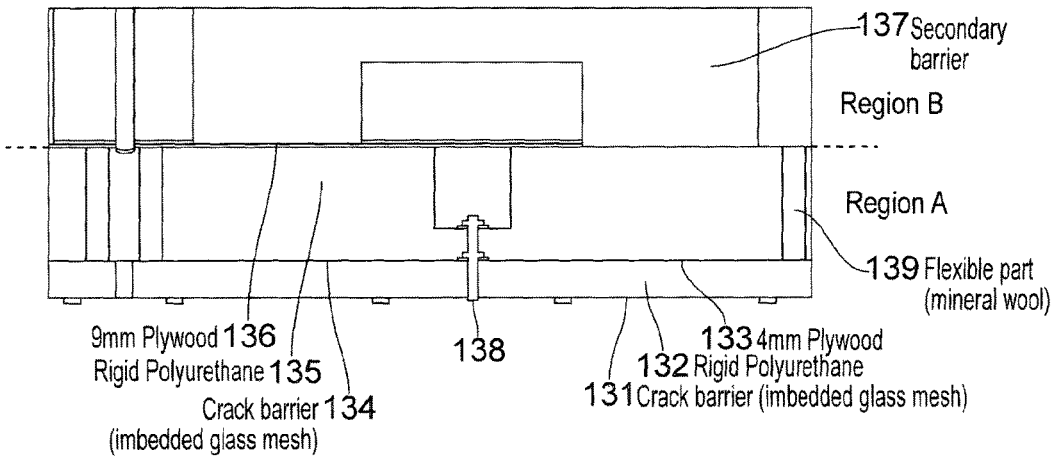

FIG. 13 shows the panel of FIG. 12 in cross-section. It should be noted that the region A is in cross-section and the region B is the top of the panel extending into the distance (see FIG. 12).

The cross-section shares a number of similarities with the first embodiment described above and it will be recognised that features may be interchanged.

Focussing on region A of FIG. 13 this represents the warm and cold portions of the panel shown in FIG. 12. Working from the outer (the lower surface) the panel is constructed of the following layers:

131—a crack barrier imbedded with glass mesh
132—a rigid polyurethane layer
133—a plywood support layer
134—a second crack barrier imbedded with glass mesh
135—a rigid polyurethane layer
136—a second plywood support layer The secondary barrier 137 (123 in FIG. 12) is located on top of the second plywood support layer.

Between adjacent panels there is provided a flexible filler 139 (125 in FIG. 12) formed of mineral wool.

Each panel is conveniently constructed around a centrally located single support fixation 138 shown in FIG. 13. This will be described in more detail below.

Figure 14:
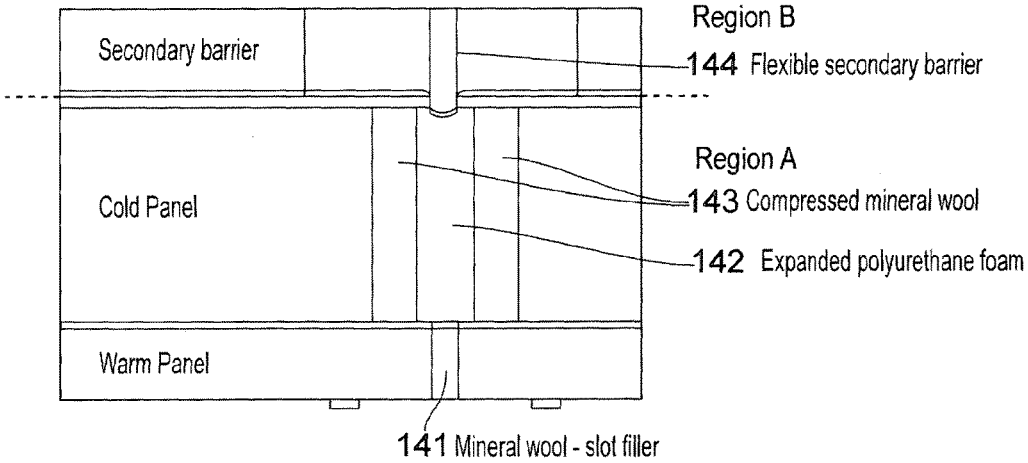

FIG. 14 shows the cryogenic joint between adjacent panels in more detail. Again, as with FIG. 13, the view is part cross-section.

When consecutive panels are located in position, as shown in FIG. 8 a space between adjacent panels is defined which must be filled and sealed to provide complete cryogenic integrity of the inner barrier surface. This is achieved by locating mineral wool 141 between adjacent warm panels, Expanded polyurethane foam 142 is located between two opposing compressed mineral wool layers 143 which in turn are in contact with respect warm layers of adjacent panels.

To provide a sealing surface on an inner surface of the panel the gap between adjacent panels is sealed with flexible secondary barrier 144 (reference 124 in FIG. 12).

As shown in FIG. 14 the flexible secondary layer 144 is concave in nature allowing for movement of adjacent panels. Movement may occur for example because of thermal expansion and/or flexing of the hull during travel.

Figure 15A:
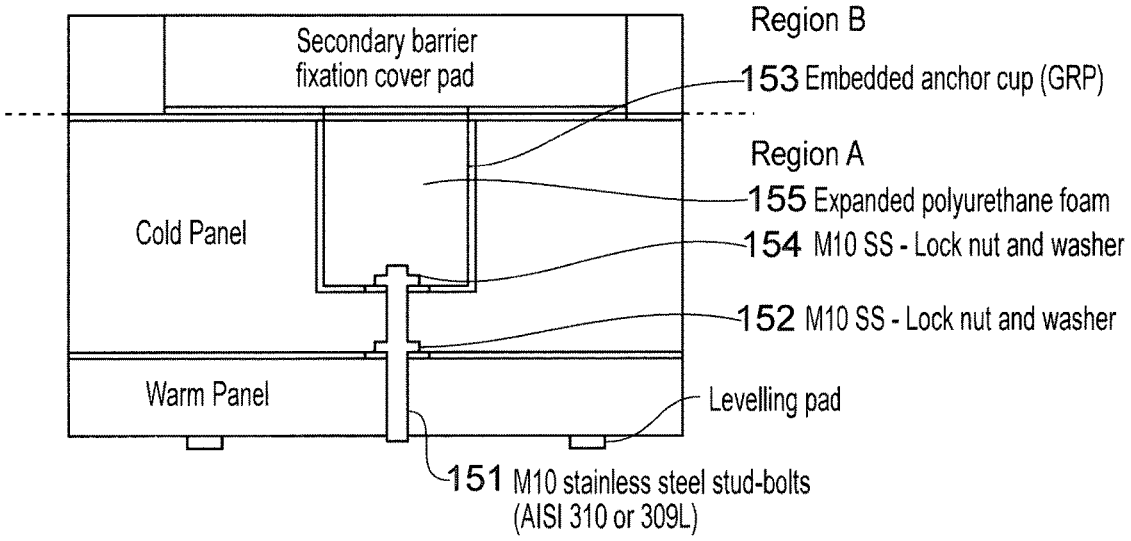
FIG. 15A and 15B show the central connecting member of FIG. 12 in cross-section and in more detail in 15B respectively.

FIG. 15A show the central connecting member of FIG. 13 in cross-section and in more detail in 15B respectively.

The single coupling advantageously serves a number of purposes.

First, it allows for convenient coupling of the panel to the hull, as shown in FIGS. 3 and 8. The central connection minimises interference with the hull. Second the single central connection allows for thermal and/or mechanical movement of the panels with respect to the hull. This maintains integrity and longevity of the barrier. Third, it facilitates installation and maintenance requiring just a single operation to make the connection between panel and hull.

Still further the single connection allows the panel to be pre-fabricated with the central coupling holding the sub-components of the panel together.

Referring to FIG. 15A the coupling comprises a first stainless steel stud bolt 151 which passes through the warm and cold panels. The warm panel is coupled to the bolt by means of lock nut and washer 152.

The cold panel is provided with a centrally located cylindrical recess into which an anchor cup 153 is located. This is described in more detail below with reference to FIG. 15B.

The anchor 153 may be formed of glass reinforced plastic. The anchor is coupled to the bolt 151 by means of a second lock nut and washer 154. Once the second lock nut and washer are located an expanded polyurethane foam 155 can be introduced into the cylindrical centre of the anchor to restore the cold panel layer. Thus, the cold panel layer incorporates an integrated anchor located about the centre of the panel defined by the bolt 151.

A secondary barrier fixation cover pad 156 is then located over the embedded anchor to provide the secondary barrier surface and again retain the integrity of the surface.

Figure 15B:
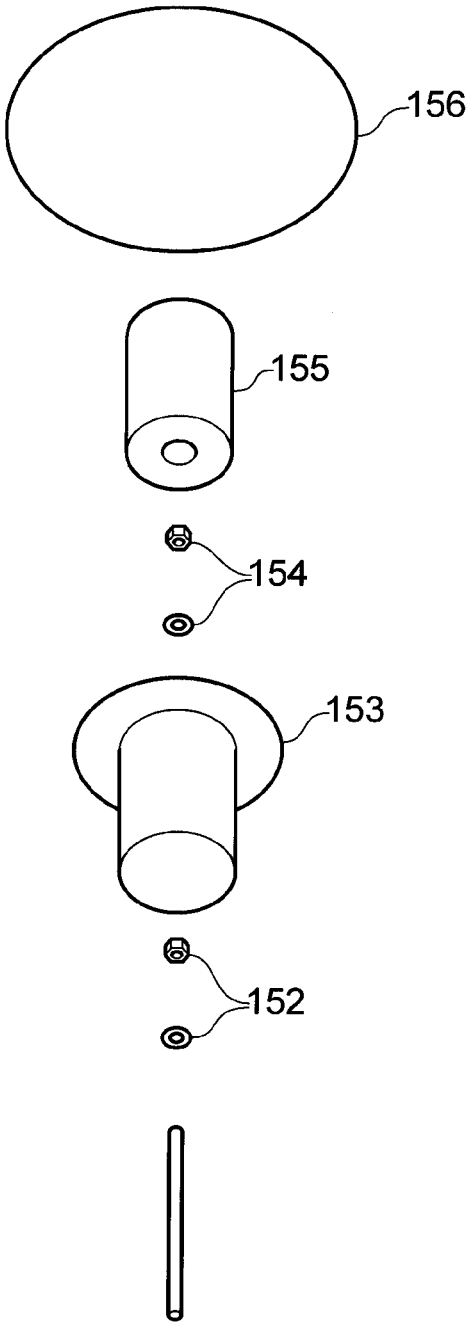

FIG. 15B shows an exploded view of the anchor arrangement showing the bolt and how it locates into the anchor 153. The expanded polyurethane foam 155 and secondary barrier 156 are also shown.

Importantly the anchor 153 is provided with a radially extending flange which engages with the inner (upper surface in FIG. 15A) of the panel and which advantageously holds the panel in compression as the lock nut and washer 154 are engaged.

The pair of locking nuts and washers in cooperation with the anchor and flange securely fasten the panel layers together.

Figure 16:
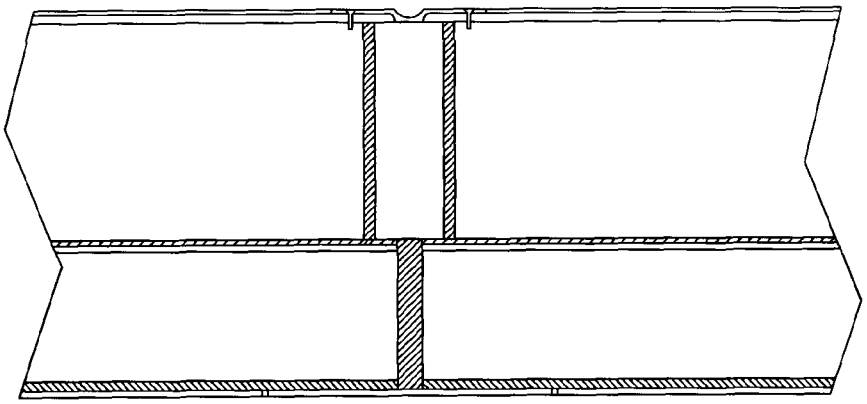

FIG. 16 shows a further alternative corner connection between adjacent panels as those shown in FIGS. 11A-11C in cross-section. A pre-formed glass reinforced plastic of metal seal member is fixed to a plywood layer with screws and adhesive. The entire surface can then be coated after the installation on the vessel.

The invention claimed is:

1. A marine vessel cryogenic barrier, comprising a plurality of multi-layered insulation panels, each insulation panel arranged to align with an adjacent insulation panel on an inner surface of a hold space of a marine vessel, each insulation panel comprising a single coupling located at a center of the insulation panel and arranged to couple the insulation panel to the inner surface of the hold space of the marine vessel, wherein the barrier is provided with an impervious layer on a surface of the barrier facing the hold space.

2. The barrier of claim 1, wherein each insulation panel comprises a main insulation layer and secondary insulation layer, and wherein the main insulation layer and the secondary insulation layer are not bonded to each other.

3. The barrier of claim 1, wherein each insulation panel comprises a first and second layer of polyurethane.

4. The barrier of claim 1, wherein the impervious layer is impervious to liquefied natural gas, liquefied propane gas or liquefied ethylene gas.

5. The barrier of claim 1, wherein the impervious layer is a glass fibre reinforced aluminium foil or a cryogenic coating.

6. The barrier of claim 1, wherein each insulation panel has a geometric shape allowing adjacent insulation panels to tessellate the inner surface of the hold space.

7. The barrier of claim 1, wherein adjacent insulation panels are separated by a joint space, said joint space being filled with an insulation material extending between edges of adjacent insulation panels and entirely filling the joint space between the adjacent insulation panels.

8. The barrier of claim 7, wherein the joint space between the adjacent insulation panels is sealed on the surface of the barrier facing the hold space with a reinforced flexible aluminium layer or cryogenic coating extending across the joint space defined between the adjacent insulation panels and overlapping a portion of the adjacent panels on the surface of the barrier facing the hold space.

9. The barrier of claim 8, wherein the reinforced flexible aluminium layer is bonded to adjacent insulation panel surfaces with a cryogenic glue.

10. The barrier of claim 9, wherein the reinforced flexible aluminium layer or the cryogenic coating is bonded to the adjacent insulation panels such that an excess of material is provided creating a concave joint profile between the adjacent insulation panels.

11. The barrier of claim 10, wherein the reinforced flexible aluminium layer or the cryogenic coating is bonded to the adjacent insulation panels such that an excess of material is provided creating a concave joint profile between intermediate layers of the adjacent insulation panels.

12. The barrier of claim 1, wherein the coupling comprises a hole passing through the center of the insulation panel and arranged to receive a threaded bolt onto which a locking nut can be thread.

13. The barrier of claim 2, wherein an intermediate layer is formed between the panels of an aluminium layer or cryogenic coating on a hold space facing side of said intermediate layer bonded to a plywood substrate.

14. The barrier of claim 13, wherein the intermediate layer is further provided with a locking nut arranged to secure the secondary insulation layer to a threaded rod passing through the insulation panel.

15. The barrier of claim 1, wherein the corner of each insulation panel is truncated such that, in use, aligning adjacent insulation panels defines an open space at a point at which four adjacent insulation panels meet.

16. The barrier as claimed in claim 15, wherein the open space defines a corner joint space, said corner joint space being filled with a polyurethane foam material extending between edges of the adjacent insulation panels and entirely filling the corner joint space between the adjacent insulation panels.

17. The barrier of claim 16, wherein the corner joint space between the adjacent insulation panels is sealed on the surface of the barrier facing the hold space with a reinforced flexible aluminium layer or a cryogenic coating extending across the corner joint space defined between the adjacent insulation panels and overlapping a portion of the adjacent insulation panels on the surface of the barrier facing the hold space.

18. The barrier of claim 17, wherein the reinforced flexible aluminium layer is bonded to adjacent insulation panel surfaces with a cryogenic glue.

19. The barrier of claim 18, wherein the reinforced flexible aluminium layer or the cryogenic coating is bonded to the adjacent insulation panels such that an excess of material is provided across the corner joint space.

20. The barrier of claim 19, wherein the excess of material forms a concave or convex dome joint profile between the adjacent insulation panels.

21. A multi-layer cryogenic barrier panel for aligning with an adjacent panel on an inner surface of a hold space of a marine vessel, said panel comprising a single through-hole at a center of the panel, said through-hole arranged to receive a coupling, wherein the panel comprises a main impervious layer on an outer surface of said panel and a second impervious layer either within the panel or on a face of the panel arranged in use to face the hold space.

22. An LNG, LPG or LEG marine vessel comprising the barrier of claim 1.

23. A marine vessel cryogenic barrier, comprising a plurality of multi-layered insulation panels, each insulation panel arranged to align with an adjacent insulation panel on an inner surface of a hold space of a marine vessel, each insulation panel comprising a single coupling located at a center of the panel, said barrier comprising a first impervious layer on a surface of the barrier facing the hold space and a second impervious layer arranged within the insulation panel; and a peripherally arranged impervious joint arranged in use to connect adjacent insulation panels to each other.

* * * * *